US010124991B2

(12) United States Patent
Valjus

(10) Patent No.: US 10,124,991 B2
(45) Date of Patent: Nov. 13, 2018

(54) CAR SPEED MONITORING ASSEMBLY FOR AN ELEVATOR

(71) Applicant: Petteri Valjus, Helsinki (FI)

(72) Inventor: Petteri Valjus, Helsinki (FI)

(73) Assignee: KONE CORPORATION, Helsinki (FI)

( * ) Notice: Subject to any disclaimer, the term of this patent is extended or adjusted under 35 U.S.C. 154(b) by 93 days.

(21) Appl. No.: 15/196,554

(22) Filed: Jun. 29, 2016

(65) Prior Publication Data

US 2017/0043978 A1 Feb. 16, 2017

(30) Foreign Application Priority Data

Aug. 13, 2015 (EP) ..... 15180923

(51) Int. Cl.

| | |
|---|---|
| ***B66B 5/04*** | (2006.01) |
| ***B66B 5/16*** | (2006.01) |
| ***B66B 1/34*** | (2006.01) |
| ***B66B 5/06*** | (2006.01) |
| *B66B 9/00* | (2006.01) |

(52) U.S. Cl.

CPC ..... *B66B 5/044* (2013.01); *B66B 1/34* (2013.01); *B66B 1/3492* (2013.01); *B66B 5/048* (2013.01); *B66B 5/06* (2013.01); *B66B 5/16* (2013.01); *B66B 9/00* (2013.01)

(58) Field of Classification Search

CPC .. B66B 5/04; B66B 5/044; B66B 5/06; G01P 3/44; G01P 3/56; F16H 2007/0891; F16H 7/10

USPC ..... 474/117, 136, 137, 138

See application file for complete search history.

(56) References Cited

U.S. PATENT DOCUMENTS 1,582,516 A * 4/1926 Gibson ..... F16H 7/1263 474/137
5,349,854 A 9/1994 Garrido et al.
6,202,795 B1 * 3/2001 Bluteau ..... B66B 5/04 187/287

(Continued)

FOREIGN PATENT DOCUMENTS

EP 1870368 A1 12/2007

OTHER PUBLICATIONS

European Search Report issued in corresponding European Application No. 15180923.

*Primary Examiner* — Minh Truong
(74) *Attorney, Agent, or Firm* — Harness, Dickey & Pierce, PLC

(57) ABSTRACT

A car speed monitoring assembly for an elevator includes an elongated flexible member tensioned to extend in a hoistway of the elevator in a longitudinal direction of the hoistway and first and second rollers mounted rotatably on an elevator car and tensioned against a lateral side of the elongated flexible member. Each roller may roll along a surface of the lateral side of the elongated flexible member based on the elevator car moving relative to the elongated flexible member. The car speed monitoring assembly may detect respective rotation speeds of the first roller and the second roller, trigger one or more particular actions when one or both of these rotation speeds exceeds a limit speed, and trigger the one or more particular actions based on the respective rotation speeds deviating from each other. The one or more particular actions include causing movement of the elevator car to be stopped.

13 Claims, 3 Drawing Sheets

(56) References Cited

U.S. PATENT DOCUMENTS

| | | | | |
|---|---|---|---|---|
| 9,463,952 | B2 * | 10/2016 | Romnes | B66B 1/3492 |
| 2001/0035315 | A1 | 11/2001 | Lindegger et al. | |
| 2004/0200671 | A1 * | 10/2004 | Kugiya | B66B 5/06 187/293 |
| 2006/0124399 | A1 * | 6/2006 | Kugiya | B66B 5/06 187/295 |
| 2007/0221452 | A1 * | 9/2007 | Aguirre | B66B 5/04 187/373 |
| 2011/0147135 | A1 * | 6/2011 | Birrer | B66B 1/3492 187/393 |
| 2012/0325590 | A1 | 12/2012 | Valjus et al. | |
| 2016/0362277 | A1 * | 12/2016 | Aguado | B66B 5/044 |

* cited by examiner

CAR SPEED MONITORING ASSEMBLY FOR AN ELEVATOR

FIELD OF THE INVENTION

This application claims priority to European Patent Application No. EP15180923.3 filed on Aug. 13, 2015, the entire contents of which are incorporated herein by reference.

The invention relates an elevator, and more specifically to the function of monitoring of overspeed of an elevator. The elevator is in particular of a kind suitable for vertically transporting passengers and/or goods.

BACKGROUND OF THE INVENTION

In elevators, the speed of the elevator can is monitored in order to avoid dangerous situations where car speed exceeds a fixed limit of safe speed set for the elevator or a limit varying in the function of car position. Overspeed might lead to situation where safe stopping is not anymore possible. A most dangerous situation would be free fall of the elevator car, for instance. Overspeed is conventionally monitored with a device known as overspeed governor. The device is arranged to bring the elevator car into a stop in case overspeed is detected. The overspeed governor typically includes a rope loop separate from hoisting ropes, which rope loop passes around rope wheels mounted in proximity of opposite ends of the elevator hoistway, and which rope loop rotates moved by the car. The rope loop is connected to a safety gear link mounted on the car. One of the rope wheels is provided with a complex mechanical mechanism arranged to activate to arrest the rope wheel in case its rotation speed exceeds a limit. Sudden stop of the rope wheel causes pull via the rope loop to the safety gear link moving along the car, which triggers actuation the safety gear mounted on the car.

A drawback of the existing solutions is that they require equipping the elevator with an additional fast moving component, i.e. the rotating rope loop, as well as the stationary rope wheels in proximity of the ends of the hoistway. An additional fast moving component, as well as wheels mounted in the limited space bring layout challenges and exceed complexity of the elevator construction. A further drawback has been that the mechanism of the overspeed governor wheel, as well as the force transmission to the safety gear have been complicated or expensive to manufacture.

BRIEF DESCRIPTION OF THE INVENTION

The objective of the invention is to provide an elevator, which is improved in terms of its arrangement for overspeed detection. An objective is particularly to alleviate one or more of the drawbacks of the existing solutions mentioned above with a solution that is reliable and simple.

It is brought forward a new elevator comprising an elongated hoistway having a longitudinal direction; an elevator car arranged to travel in said hoistway along a path extending in said longitudinal direction and a car speed monitoring arrangement, the car speed monitoring arrangement comprising an elongated flexible member tensioned to extend in said hoistway in said longitudinal direction a first roller, mounted rotatably on the car and tensioned against a lateral side of the elongated flexible member to roll along the surface thereof when the car moves relative to the elongated flexible member; and a second roller, mounted rotatably on the car and tensioned against a lateral side of the elongated flexible member to roll along the surface thereof when the car moves relative to the elongated flexible member. The speed monitoring arrangement is configured to detect rotation speed (e.g. rpm or circumferential speed) of the first roller and the rotation speed (e.g. rpm or circumferential speed) of the second roller; and to trigger one or more predefined actions when one or both of these rotation speeds exceed a limit; and furthermore to compare these speeds with each other; and to trigger one or more predefined actions when these rotation speeds deviate from each other. Said one or more predefined actions include at least actions for stopping movement of the elevator car. Particularly, in this configuration, each said first and second roller is arranged to be forced by the flexible elongated member to rotate when relative movement is caused between the car and the flexible elongated member. With this configuration, one or more of the above mentioned advantages and/or objectives are achieved. In particular, with this configuration a reliable solution is achievable. With this configuration, abnormal situations can be detected early regardless of the speed or direction of travel of the car. Also, in this way abnormal situations are reacted to in an appropriate manner. The configuration can perform self-monitoring function, whereby safety of the solution is increased. For this reason, the solution can be implemented without safety issues relatively largely with electrical components, whereby complex mechanical mechanisms can be omitted. Preferable further features are introduced in the following, which further features can be combined with the method individually or in any combination.

In a preferred embodiment, the elongated flexible member is belt-shaped. Thereby the lateral side is wide and it can be firmly engaged by a roller with large contact area formed between the elongated flexible member and the roller.

In a preferred embodiment, the elongated flexible member has a coating made of polymer material, the coating forming the outer surface of the elongated flexible member, and each said roller is tensioned against a lateral side of the elongated flexible member formed by the coating to roll along the surface thereof. The coating facilitates reduction of slip, which is important both for accuracy and reliability of detection of each individual roller but also for comparison of the detection of the two rollers. With increased capacity for high friction contact, it is facilitated that each roller is forced to rotate without slip by the flexible elongated member when relative movement is caused between the car and the flexible elongated member. The coating is preferably elastic, such as polyurethane. Elastic material, and particularly polyurethane provides the elongated flexible member good frictional properties and wear resistance.

In a preferred embodiment, the elongated flexible member comprises one or more tension members embedded in a coating, which is made of polymer material and forms the outer surface of the elongated flexible member. Tension members are the members suitable for transmitting tension in the longitudinal direction of the flexible elongated member. The tension members are particularly suitable for transmitting tension caused by pulling from the first end of the flexible elongated member to the second end. Preferably, said one or more tension members are made of composite material comprising reinforcing fibers embedded in polymer matrix, said reinforcing fibers preferably being carbon fibers. Thus, advantageously high tensile stiffness, as well as rigidity against bending can be provided with the elongated flexible member.

In a preferred embodiment, the elongated flexible member is toothed or ribbed comprising one or more lateral sides provided with a tooth-pattern (of teeth extending in cross direction of the member) or a rib-pattern (of elongated ribs extending parallel with the longitudinal direction of the member), said one or more lateral sides including the lateral side against which the first roller and/or the second roller are tensioned, the roller in question comprising a tooth-pattern or a rib-pattern forming a counterpart for the pattern of the lateral side. Preferably, said ribs/teeth are formed by the coating of the elongated flexible member.

In a preferred embodiment, the elongated member is belt-shaped, whereby it is larger in its width direction than in its thickness direction, having two wide lateral sides, i.e. sides facing in thickness direction of the elongated member, and said lateral side against which the first roller is tensioned is a wide side of the elongated member, and said lateral side against which the second roller is tensioned is a wide side of the elongated member.

In a preferred embodiment, the flexible member mounted such that it remains stationary when the car is moved in the hoistway. Thus, relative movement between the car and the elongated flexible member can be used for accurately determining speed of the elevator car. Preferably, the elongated member has a first end fixed to a stationary structure of the elevator (directly or via tensioning means between said end and the stationary structure) in proximity of the first end of the hoistway, and a second end fixed to a stationary structure of the elevator (directly or via tensioning means between said end and the stationary structure) in proximity of the second end of the hoistway.

In a preferred embodiment, the speed monitoring arrangement comprises one or more rotation speed detectors for detecting rotation speeds of the first roller and the second roller. Said detectors are preferably electrical.

In a preferred embodiment, said one or more rotation speed detectors for detecting rotation speeds of the first roller and the second roller comprise a first detector for detecting rotation speed of the first roller and a second detector for detecting rotation speeds of the second roller. Thus, a dual system is provided whereby the system is not sensitive to breakage of a single component and safety is increased.

In a preferred embodiment, each said detector is in the form of encoder.

In a preferred embodiment, the first and second roller are tensioned against the same lateral side of the elongated flexible member. Preferably, the elongated flexible member is belt-shaped and said lateral side is a wide side of the belt-shaped elongated member, i.e. the side facing in thickness direction of the elongated member. Thus, large contact area is formed between each roller and the elongated flexible member.

In a preferred embodiment, the elevator comprises a mounting frame for mounting the first and second roller on the car, on which mounting frame the first and second roller are rotatably supported.

In a preferred embodiment, said one or more predefined actions include actions for stopping movement of the elevator car, and the elevator comprises one or more car brakes and/or one or more machine brakes and said stopping is arranged to be carried out by said one or more car brakes and/or by said one or more machine brakes. Preferably, the car speed monitoring arrangement is connected with the one or more car brakes and/or one or more machine brakes. The car brake can serve the function of a device known as a safety gear.

In a preferred embodiment, the elevator comprises one or more machine brakes actuatable to engage a rope wheel or a component fixed thereto for braking rotation of the rope wheel, around which rope wheel ropes/roping connected with the car pass, and said actions for stopping movement of the elevator car include actuation of said one or more brakes (in which actuation the brakes move to braking state).

In a preferred embodiment, the elevator comprises one or more guide rail line mounted in the hoistway for guiding movement of the elevator car, and one or more car brakes mounted on the car and actuatable to engage a guide rail line for braking movement of the car, and said actions for stopping movement of the elevator car include actuation of said one or more car brakes.

In a preferred embodiment, the speed monitoring arrangement comprises an auxiliary roller mounted rotatably on the car and tensioned against a lateral side of the elongated flexible member to roll along the surface thereof when the car moves relative to the elongated flexible member, said lateral side being opposite the lateral side against which the first and second roller are tensioned.

In a preferred embodiment, the auxiliary roller is positioned between the first and second roller as viewed along the length of the elongated flexible member. Thereby, the contact points where the first and second roller contact the flexible elongated member are in vertical direction on opposite sides of the contact point where the auxiliary roller contacts the elongated flexible member.

In a preferred embodiment, the auxiliary roller is tensioned against the elongated flexible member such that it bends to extend slightly into the gap existing in vertical direction between the rollers. Thereby, the contact angle between the elongated flexible member and each roller is increased. Preferably, the elongated flexible member is made elastically bendable. Then, the mere straightening tendency thereof produces a normal force between the rollers and the elongated flexible member enough to facilitate considerably non-slipping traction. Elastic bendability as well as good rigidity can be provided for the elongated flexible member by providing it with one or more tension members described elsewhere in the application, in particular with one or more tension members made of composite material comprising reinforcing fibers embedded in polymer matrix, said reinforcing fibers preferably being carbon fibers.

In a preferred embodiment, the elongated flexible member is a rod having a straight form when in rest state and elastically bendable away from the straight form. Thus, it self-reverses back to a straight form from bent form in rest state after all bending directed to it ceases. Thus, the advantages of said elastic bendability are most considerable.

In a preferred embodiment, the elevator comprises one or more springs for tensioning the rollers. Preferably, the one or more springs are mounted between a mounting frame on which the first and second roller are rotatably supported and a mounting frame on which the auxiliary roller is rotatably supported.

In a preferred embodiment, the elevator comprises one or more guide rail line mounted in the hoistway for guiding movement of the elevator car, and one or more car brakes mounted on the car and actuatable, preferably with an electrical control signal, to engage a guide rail line for braking movement of the car.

In a preferred embodiment, the car brake comprises an actuator, said actuator comprising an actuating means preferably in the form of a (pre-)loaded spring, arranged to urge a brake element of the brake into braking position if released, and a holding means, preferably in the form of a solenoid, said holding means being arranged to hold the actuator in the loaded state when energized, said control signal being in the form of interruption of supply of energizing electricity of the holding means.

In a preferred embodiment, the car brake comprises brake element in the form of a wedge member placed in a wedge-shaped space having a narrowing end, the wedge shaped space being delimited on one side by the guide rail line, the wedge member being wedgeable in the wedge-shaped space to press against the guide rail line by moving it towards the narrowing end.

In a preferred embodiment, the car speed monitoring arrangement comprises a monitoring unit mounted on the car. The monitoring unit preferably comprises processing means such as one or more microprocessors. Plural microprocessors can be used to provide redundancy for the operations of the processing means, whereby the system's safety can be further facilitated.

In a preferred embodiment, the car speed monitoring arrangement, in particular the monitoring unit thereof, is connected with the car brake via an electrical connection for sending an electrical control signal to the car brake for actuating the car brake.

In a preferred embodiment, the car speed monitoring arrangement, in particular the monitoring unit thereof is provided for sending an electrical control signal to trigger said actions for stopping movement of the elevator car, such as an electrical control signal to the car brake for actuating the car brake.

In a preferred embodiment, the car speed monitoring arrangement, in particular the monitoring unit thereof comprises processing means, such as one or more microprocessors configured to compare speeds of the first and second roller with each other and the speed of the first and/or the second roller with a limit speed.

In a preferred embodiment, the car speed monitoring arrangement, in particular the monitoring unit thereof comprises processing means, such as one or more microprocessors, configured to convert data obtained by rotation speed detection into speed data usable for comparison of the speeds of the first and second roller for determining said deviation and/or for comparison of the speed of the first roller and/or second roller with a limit speed.

In a preferred embodiment, said speed data indicates circumferential speed values of the rollers.

In a preferred embodiment, the value of the limit speed is greater that the value detected when the car moves at nominal speed of the elevator. Thus, the car speed monitoring arrangement is configured to detect if the car travels with speed exceeding the nominal speed thereof. Thus, the solution can be used to replace a conventional overspeed governor.

In a preferred embodiment, the elevator does not have any other component arranged to travel along the elongated flexible member.

In a preferred embodiment, the reinforcing fibers of each tension member are substantially evenly distributed in the polymer matrix of the tension member in question. Furthermore, preferably, over 50% of the cross-sectional square area of the tension member consists of said reinforcing fibers. Thereby, a high tensile stiffness can be facilitated. Preferably, the tension members cover together at least a 25-75% proportion of the cross-section of the elongated flexible member, most preferably over 50% proportion of the cross-section of the elongated flexible member.

In a preferred embodiment, substantially all the reinforcing fibers of each tension member are parallel with the longitudinal direction of the tension member. Thereby the fibers are also parallel with the longitudinal direction of the elongated flexible member as each tension member is oriented parallel with the longitudinal direction of the elongated flexible member. This facilitates further the stiffness of the elongated flexible member.

In a preferred embodiment, the width/thickness ratio of the elongated flexible member is more than two, preferably more than 4.

In a preferred embodiment, the elongated flexible member is not arranged to suspend an elevator car or counterweight of the elevator.

In a preferred embodiment, the elevator has only components of said car speed monitoring arrangement arranged to travel along the surface of the elongated flexible member. Thereby the elevator does not have any other component arranged to travel along the elongated flexible member. This would be likely to cause smudge, wear or some other disturbance with the effect of deteriorating the traction between the elongated flexible member and the rollers thereby causing eventually slip or contact failures.

The elevator is preferably such that the car thereof is arranged to serve two or more landings. The elevator preferably comprises an elevator control unit controlling movement of the car in response to calls from landing(s) and/or destination commands from inside the car so as to serve persons on the landing(s) and/or inside the elevator car. Preferably, the car has an interior space suitable for receiving a passenger or passengers, and the car can be provided with a door for forming a closed interior space.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
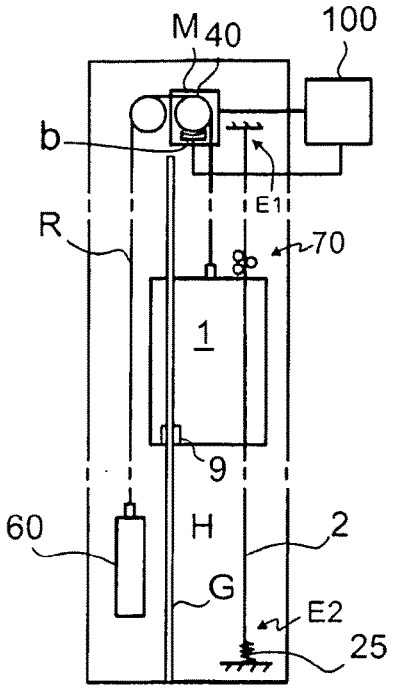
FIG. 1 illustrates an elevator according to an embodiment.

FIG. 1 illustrates an elevator according to an embodiment. The elevator comprises an elongated hoistway H having a longitudinal direction and an elevator car 1 arranged to travel in said hoistway H along a path extending in said longitudinal direction. The elevator further comprises means for moving the car 1 including in this case a counterweight and a roping R interconnecting the car 1 and counterweight 60 as well as a drive means M,40,100 arranged to act on the roping R for exerting driving force thereto. The elevator further comprises a car speed monitoring arrangement 70 comprising an elongated flexible member 2 tensioned to extend in said hoistway H parallel with said longitudinal direction, the elongated flexible member having a first end E1 fixed to a stationary structure of the elevator in proximity of the first end of the hoistway, and a second end E2 fixed to a stationary structure of the elevator in proximity of the second end of the hoistway. The flexible member 2 is thereby mounted such that it remains stationary when the car 1 is moved in the hoistway. It follows that each roller 3,4 is forced to rotate by the flexible elongated member 2 when relative movement is caused between the car 1 and the flexible elongated member 2. Thus, relative movement between the car 1 and the elongated flexible member 2 can be used for determining speed of the elevator car 1. One or both of the first and second end E1,E2 can be fixed to the stationary structure either directly or via a tensioning means 25 for tensioning the elongated flexible member 2. Said tensioning means 25 can comprise a spring mechanism, as presented, for pulling the elongated flexible member 2 straight or a tension weight for pulling the elongated flexible member 2 straight.

Figure 2A:
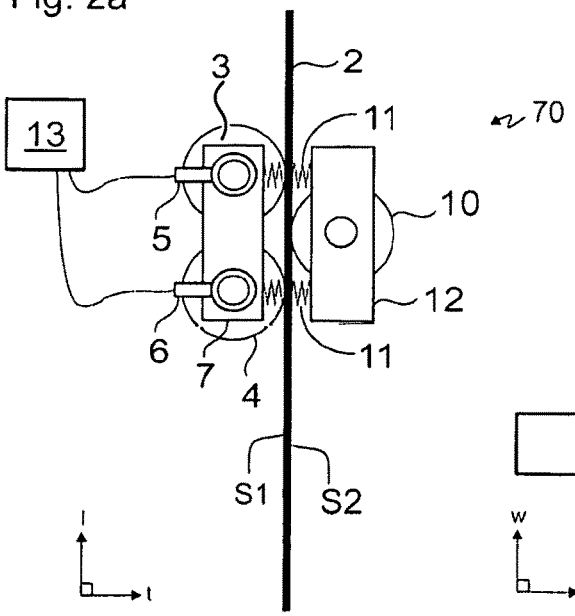
FIG. 2*a* illustrates preferred details for the speed monitoring arrangement.
Figure 2B:
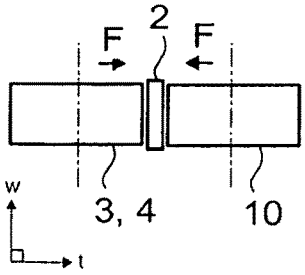
FIG. 2*b* illustrates a top view of rollers and an elongated flexible member of FIG. 2*a*.

FIG. 2 illustrates preferred details for the speed monitoring arrangement 70. The car speed monitoring arrangement 70 further comprises a first roller 3 mounted rotatably on the car 1 and tensioned against a lateral side S1 of the elongated flexible member 2 to roll along the surface thereof when the car moves relative to the elongated flexible member 2, and a second roller 4, mounted rotatably on the car and tensioned against a lateral side S1 of the elongated flexible member 2 to roll along the surface thereof when the car 1 moves relative to the elongated flexible member 2. The speed monitoring arrangement 70 is configured to detect rotation speed, such as rpm or circumferential speed for example, of the first roller 3 and correspondingly the rotation speed of the second roller 4, and to trigger one or more predefined actions when one or both of these rotation speeds exceed a limit. Hereby, it serves as a speed limiting device. The speed monitoring arrangement 70 is further configured to compare said detected speeds with each other, and to trigger one or more predefined actions when these rotation speeds deviate from each other. Hereby, the speed monitoring arrangement performs self monitoring as well, and in response to undesired outcome assumed to mean incorrect operation of the arrangement, i.e. detection of said deviation, predefined actions are triggered. Said one or more predefined actions include at least actions for stopping movement of the elevator car 1. With this configuration, abnormal situations can be detected early regardless of the speed or direction of travel of the car. Also, in this way abnormal situations are reacted to in an appropriate manner. Thus, the elevator can be provided with a safe arrangement suitable for serving as an overspeed limiter. Said deviation can be deviation in a predefined manner, such as when detected rotation speeds deviate from each other by amount exceeding a predefined limit. Said predefined limit is preferably greater than zero, because zero would likely mean false alarms resulting from inevitable inaccuracy of speed detection.

The elongated flexible member 2 is preferably belt-shaped whereby it is larger in its width direction w than in its thickness direction t wherein said thickness direction and width direction and length direction of the elongated flexible member 2 are orthogonal to each other. Preferably, then said lateral side S1 against which the first roller 3 and the second roller are tensioned is the side facing in thickness direction t of the elongated member 2 Thereby the lateral side S1 is wide and simple to be engaged by the roller 3,4 with large contact area.

The elongated flexible member 2 preferably has a coating 8 made of polymer material, and each said roller 3,4 is tensioned against a lateral side S1 of the elongated flexible member 2 formed by the coating 8 to roll along the surface of the lateral side S1 formed by the coating 8. The coating facilitates reduction of slip, which is important both for accuracy and reliability of detection of each individual roller 3,4 but also for comparison of the detection of the two rollers 3 and 4. With increased friction, it is facilitated that each roller 3,4 is forced to rotate without slip by the flexible elongated member 2 when relative movement is caused between the car 1 and the flexible elongated member 2.

As mentioned, said one or more predefined actions include actions for stopping movement of the elevator car 1. Said stopping is preferably carried out by car brakes 9. Thus, if the problematic situation was caused by loss of suspension, e.g. due to ropes being cut, this will not have any effect on reliability of the triggered actions for bringing the car 1 into a swift stop. This is preferably implemented such that the elevator comprises one or more guide rail lines G mounted in the hoistway for guiding movement of the elevator car 1), as well as one or more car brakes 9 mounted on the car (1) and actuatable to engage a guide rail line G for braking movement of the car 1, and actions for stopping movement of the elevator car 1 include actuation of said one or more car brakes 9. Additionally, or even alternatively, said stopping is carried out by machine brakes b. This is preferably implemented such that the elevator comprises one or more (machine) brakes b actuatable to engage a rope wheel 40 or a component fixed thereto for braking rotation of the rope wheel 40, around which rope wheel ropes R connected with the car 1 pass, and said actions for stopping movement of the elevator car include actuation of said one or more brakes b (in which actuation the brakes move to braking state).

For carrying out the tasks of triggering the one or more predefined actions, as well as the task of comparison, the car speed monitoring arrangement 70 comprises a monitoring unit 13 mounted on the car 1. The monitoring unit 13 preferably comprises processing means such as microprocessor(s) for carrying out the aforementioned tasks. The processing means, such as one or more microprocessors, are configured to compare speeds of the first and second roller 3,4 and the speed of the first and/or the second roller with a limit speed. Furthermore, the monitoring unit 13 is preferably provided for sending a control signal to trigger said one or more predefined actions, such as a control signal to the car brake 9 for actuating the car brake.

The monitoring unit 13 can furthermore carry out further tasks not mentioned here. The processing means, such as one or more microprocessors, can be configured to convert data obtained by rotation speed detection into speed data (such as speed data indicating circumferential speed values of the rollers 3,4) usable for comparison of the speeds of the first and second roller for determining said deviation and/or for comparison of the speed of the first roller and/or second roller with a limit speed. For example, should there be need for decoding the signals received by the monitoring unit 13 from the detectors 5,6 such as the encoder signals, this can be carried out by the processing means of the monitoring unit 13 as well. The monitoring unit 13 can be in the form of a computer, for instance.

Figure 3:
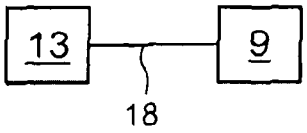
FIG. 3 illustrates a connection between the speed monitoring arrangement and a brake of the elevator.

So as to enable actuation of brakes the car speed monitoring arrangement 70 is connected with the one or more car brakes 9 and/or one or more machine brakes b. In the preferred embodiment illustrated, the car speed monitoring arrangement 70, in particular the monitoring unit 13 thereof, is connected with the car brake 9 via a connection 8 for sending a control signal to the car brake 9 for actuating the car brake 9. The connection 18 is illustrated in FIG. 3. The control signal is preferably an electrical signal. Said connection 18 can be electrical, an electrical wire for instance.

The speed monitoring arrangement furthermore comprises one or more rotation speed detectors 5,6 for detecting rotation speeds of the first roller 3 and the second roller 4. In the preferred embodiment illustrated in FIG. 2*a*, said one or more rotation speed detectors 5,6 for detecting rotation speeds of the first roller 3 and the second roller 4 comprise a first detector 5 for detecting rotation speed of the first roller 3 and a second detector 6 for detecting rotation speeds of the second roller 4. Each said detector 5,6 is preferably an electrical detector, most preferably in the form of encoder. Encoders are widely used for rotation speed detection, such as in rotation speed detection of elevator drive wheels, and their operation principles are not further explained here.

The first and second roller 3,4 are tensioned against the same lateral side S1 of the elongated flexible member 2. The advantage is that they can be used to detect speed of the same side, whereby likelihood of inaccuracies is reduced, but also that only one side of the elongated flexible member needs to be contoured to facilitate reducing slipping. Said lateral side S1 is a wide side of the elongated member 2, i.e. the side facing in thickness direction t of the elongated member 2. Thus, large contact area can be formed between each roller 3,4 and the elongated flexible member 2. The mounting is implemented such that the arrangement 70 comprises a mounting frame 7 for mounting the first and second roller 3,4 on the car 1, on which mounting frame 7 the first and second roller are rotatably supported.

As mentioned, each said first 3 and second roller 4 is arranged to be forced by the flexible elongated member 2 to rotate when relative movement is caused between the car 1 and the flexible elongated member 2. So as to produce reaction force for the tensioning, the speed monitoring arrangement 70 comprises an auxiliary roller 10 mounted rotatably on the car 1 and tensioned against a lateral side of the elongated flexible member 2 to roll along the surface thereof when the car 1 moves relative to the elongated flexible member 2, said lateral side being opposite the lateral side S1 against which the first and second roller 3,4 are tensioned. Although preferable, presence of the auxiliary roller is not absolutely necessary, because tension of the elongated flexible member 2 could in some solutions be regarded to produce sufficient reaction force. In the presented embodiment, the auxiliary roller 10 is positioned between the first and second roller 3,4 as viewed along the length of the flexible member 2. Thereby the contact points where the first and second roller 3,4 contact the elongated flexible member 2 are in vertical direction on opposite sides of the contact point where the auxiliary roller contacts the elongated flexible member 2. Thus, a layout is formed where the auxiliary roller 10 tensioned against the elongated flexible member 2) bends it to extend slightly into the gap existing in vertical direction between the rollers 3,4 whereby the contact angle between the elongated flexible member 2 and each roller 3,4 is increased. When the elongated flexible member 2 is made elastically bendable and sufficiently rigid, the mere straightening tendency thereof produces a normal force between the rollers 3,4 and the elongated flexible member 2 enough to facilitate considerably non-slipping traction. Such an elastic bendability can be provided with the elongated flexible member 2 by providing it with one or more tension members 14 described elsewhere in the application, in particular with one or more tension members 14 made of composite material comprising reinforcing fibers f embedded in polymer matrix m, said reinforcing fibers preferably being carbon fibers. It is of course, possible that the rigidity of this kind can be obtained by other kind of construction of the elongated flexible member 2.

The tensioning of the rollers 3,4,10 is preferably implemented by springs 11, which may be in any known form of springs suitable for producing a spring force F, such as helical springs or pneumatic springs. As illustrated in FIG. 2*a*, in the referred embodiment the elevator comprises one or more springs 11 (in this case two) for tensioning the rollers 3,4,10. The one or more springs 11 are mounted in the present case to act between a mounting frame 7 on which the first and second roller 3,4 are rotatably supported and a mounting frame 12 on which the auxiliary roller 10 is rotatably supported, and particularly to pull these frames 7 and 12 towards each other, thereby pulling the rollers 3,4 and the auxiliary roller 12 towards each other such that the gap between the rollers 3,4 and 12 is narrowed, through which gap the elongated flexible member 2 passes.

Figure 4:
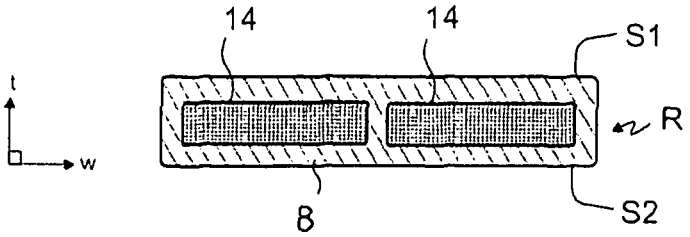
FIGS. 4 and 5 illustrate preferred alternative details of the elongated flexible member.
Figure 5:
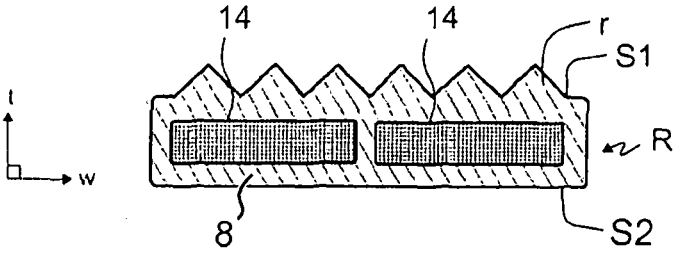

FIGS. 4 and 5 illustrate preferred alternative details of the belt-shaped elongated flexible member 2. Figures illustrate each a cross section of the elongated flexible member 2. In the preferred embodiments shown, the elongated flexible member 2 comprises a coating 8 made of polymer material the coating 8 forming the outer surface of the elongated flexible member 2.

The elongated flexible member 2 further comprises one or more tension members 14 embedded in the coating 8 which one or more tension members 14 extend parallel to the longitudinal direction I of the elongated flexible member 2 unbroken throughout the length of the elongated flexible member 2. In case there are plurality of the tension members 14, they are adjacent each other in width direction w of the elongated flexible member 2 as illustrated. In the present case, there are two of said tension members 14 embedded in said coating 8, but the elongated flexible member 2 could alternatively have any other number of tension members 14, such as only one tension member 14 wide in width direction of the elongated flexible member 2 or more than two, such as 3-8, or even more.

The coating 8 is preferably elastic. Then said polymer material is elastomer. With the coating 8, the elongated flexible member 2 is provided with a surface via which the elongated flexible member 2 can effectively engage (frictionally or via positive connection) with the rollers 3,4 for forcing them to roll along the elongated flexible member instead of sliding, when relative movement occurs. Also, hereby the friction properties of the elongated flexible member 2 of the elongated flexible member 2 are adjustable to perform well in the intended use, for instance in terms of traction. Furthermore, the tension members 14 embedded therein are thus provided with protection. Elastic material, and particularly polyurethane provides the elongated flexible member 2 good frictional properties and wear resistance. Polyurethane is in general well suitable for elevator use, but also materials such as rubber or equivalent elastic materials are suitable for the material of the coating. Said one or more tension members 14 is/are preferably, but not necessarily, made of composite material comprising reinforcing fibers f embedded in polymer matrix m, said reinforcing fibers preferably being carbon fibers. With this kind of structure, the elongated flexible member 2 is elastically bendable and rigid against bending. Preferred structure of the tension members 14 is further described referring to FIGS. 7 and 8.

As mentioned, the elongated flexible member 2 is belt-shaped, whereby it is larger in its width direction w than in its thickness direction t. The elongated flexible member 2 being belt-shaped the elongated flexible member 2 section S has opposite wide lateral sides S1,S2, i.e. sides facing in thickness direction t of the elongated member 2, wide sides which can be engaged to by the rollers 3,4,10 with large contact area. The width/thickness ratio of the elongated flexible member 2 is preferably at least 2 more preferably at least 4, or even more. In this way a large cross-sectional area for the elongated flexible member 2 is achieved, Also, it is preferable that the tension members 14 are wide. Accordingly, each of said one or more tension members 14 is preferably larger in its width direction w than in its thickness direction t of the elongated flexible member 2. Particularly, the width/thickness ratio of each of said one or more tension members is preferably more than 2. Thereby, the cross section of the elongated flexible member 2 is effectively utilized.

The elongated flexible member 2 can have a smooth opposite wide sides S1,S2 as illustrated in FIG. 4. Alternatively, it can be toothed or ribbed comprising at least one lateral sides S1 provided with a tooth-pattern (of teeth extending in cross direction of the member 2) or a rib-pattern (of elongated ribs extending parallel with the longitudinal direction of the member 2). FIG. 5 illustrates a cross section for the elongated flexible member 2 when it has one lateral sides S1 provided with a rib-pattern. The ribbed lateral side S1 is the lateral side against which the first roller 3 and the second roller 4 are tensioned, in which case the roller 3,4 in question comprises a rib-pattern forming a counterpart for the pattern of the lateral side S1. Said ribs (or teeth) are formed by the coating 8.

Figure 6:
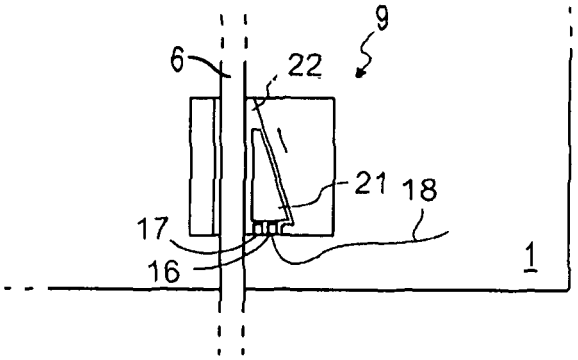
FIG. 6 illustrates preferred further details for the car brake.

FIG. 6 illustrates preferred further details for the car brake 9. In the presented case, the elevator comprises one or more guide rail line G mounted in the hoistway H for guiding movement of the elevator car 1, and one or more car brakes 9 mounted on the car 1 and actuatable with a control signal to engage a guide rail line G for braking movement of the car 1. The car brake 9 comprises an actuator 16,17, said actuator 16,17 comprising an actuating means 16 preferably in the form of a loaded spring, arranged to urge a brake element 21 of the brake into braking position if released, and a holding means 17, preferably in the form of a solenoid, said holding means 17 being arranged to hold the actuator 16 in the loaded state when energized, said control signal being in the form of interruption of supply of energizing electricity of the holding means 17. Moreover, the car brake 9 comprises a brake element 21 in the form of a wedge member 21 placed in a wedge-shaped space 22 having a narrowing end, the wedge shaped space 22 being delimited on one side by the guide rail line G, the wedge member 21 being wedgeable in the wedge-shaped to press against the guide rail line G space 22 by moving it towards the narrowing end. The monitoring unit 13) is connected with the car brake 9, in particular with the actuator thereof via an electrical connection 18 for sending an electrical control signal to the car brake 9 for actuating the car brake 9.

Figure 7:
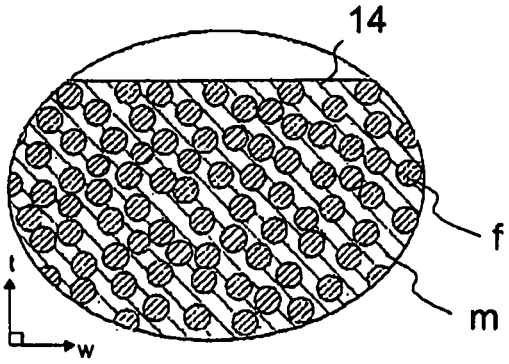
FIG. 7 illustrates partially a preferred cross section of a tension member of the elongated flexible member as viewed in longitudinal direction of tension member and the elongated flexible member.
Figure 8:
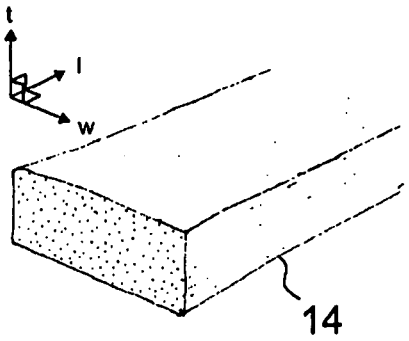
FIG. 8 illustrates three-dimensionally a tension member of the elongated flexible member.

FIG. 7 illustrates a preferred inner structure for said tension member 14, showing inside the circle an enlarged view of the cross section of the tension member 14 close to the surface thereof, as viewed in the longitudinal direction I of the tension member 14. The parts of the tension member 14 not showed in FIG. 7 have a similar structure. FIG. 8 illustrates the tension member 14 three dimensionally. The tension member 14 is made of composite material comprising reinforcing fibers f embedded in polymer matrix m. The reinforcing fibers f are more specifically distributed substantially evenly in polymer matrix m and bound to each other by the polymer matrix. The tension member 14 formed is a solid elongated rod-like one-piece structure. Said reinforcing fibers f are most preferably carbon fibers, but alternatively they can be glass fibers, or possibly some other fibers such as glass fibers. Preferably, substantially all the reinforcing fibers f of each tension member 14 are parallel with the longitudinal direction I of the tension member 14. Thereby, the fibers f are also parallel with the longitudinal direction of the elongated flexible member 2 as each tension member 14 is oriented parallel with the longitudinal direction of the elongated flexible member 2. This is advantageous for the rigidity as well as behavior in bending. Owing to the parallel structure, the fibers in the elongated flexible member 2 will be aligned with the force when the elongated flexible member 2 is pulled, which ensures that the structure provides high tensile stiffness. The fibers f used in the preferred embodiments are accordingly substantially untwisted in relation to each other, which provides them said orientation parallel with the longitudinal direction of the flexible member 2. The reinforcing fibers f are preferably long continuous fibers in the longitudinal direction of the tension member 14, preferably continuing for the whole length of the tension member 14.

As mentioned, the reinforcing fibers f are preferably distributed in the aforementioned tension member 14 substantially evenly. The fibers f are then arranged so that the tension member 14 would be as homogeneous as possible in the transverse direction thereof. An advantage of the structure presented is that the matrix m surrounding the reinforcing fibers f keeps the interpositioning of the reinforcing fibers f substantially unchanged. It equalizes with its slight elasticity the distribution of force exerted on the fibers, reduces fiber-fiber contacts and internal wear of the elongated flexible member 2, thus improving the service life of the flexible member 2. Owing to the even distribution, the fiber density in the cross-section of the tension member 14 is substantially constant. The composite matrix m, into which the individual fibers f are distributed, is most preferably made of epoxy, which has good adhesiveness to the reinforcement fibers f and which is known to behave advantageously with reinforcing fibers such as carbon fiber particularly. Alternatively, e.g. polyester or vinyl ester can be used, but any other suitable alternative materials can be used.

The matrix m has been applied on the fibers f such that a chemical bond exists between each individual reinforcing fiber f and the matrix m. Thereby a uniform structure is achieved. To improve the chemical adhesion of the reinforcing fiber to the matrix m, in particular to strengthen the chemical bond between the reinforcing fiber f and the matrix m, each fiber can have a thin coating, e.g. a primer (not presented) on the actual fiber structure between the reinforcing fiber structure and the polymer matrix m. However, this kind of thin coating is not necessary. The properties of the polymer matrix m can also be optimized as it is common in polymer technology. For example, the matrix m can comprise a base polymer material (e.g. epoxy) as well as additives, which fine-tune the properties of the base polymer such that the properties of the matrix are optimized. The polymer matrix m is preferably of a hard non-elastomer, such as said epoxy, as in this case the rigidity against bending is increased and tendency of the member 2 to straighten is increased which is advantageous for increasing the normal force between the rollers 3,4 and the member 2 produced by auxiliary roller 10, but also for decreasing need for tensioning of the member 2. However, the polymer matrix need not be non-elastomer necessarily, e.g. if the downsides of this kind of material are deemed acceptable or irrelevant for the intended use. In that case, the polymer matrix m can be made of elastomer material such as polyurethane or rubber for instance.

The reinforcing fibers f being in the polymer matrix means here that the individual reinforcing fibers f are bound to each other with a polymer matrix m, e.g. in the manufacturing phase by immersing them together in the fluid material of the polymer matrix which is thereafter solidified. The reinforcing fibers f together with the matrix m form a uniform tension member 14, inside which no substantial abrasive relative movement occurs when the elongated flexible member is bent. The individual reinforcing fibers f of the tension member 14 are mainly surrounded with polymer matrix m, but random fiber-fiber contacts can occur because controlling the position of the fibers in relation to each other in their simultaneous impregnation with polymer is difficult, and on the other hand, perfect elimination of random fiber-fiber contacts is not necessary from the viewpoint of the functioning of the solution. If, however, it is desired to reduce their random occurrence, the individual reinforcing fibers f can be pre-coated with material of the matrix m such that a coating of polymer material of said matrix is around each of them already before they are brought and bound together with the matrix material, e.g. before they are immersed in the fluid matrix material.

As above mentioned, the matrix m of the tension member 14 is most preferably hard in its material properties. A hard matrix m gives efficiently to support for the reinforcing fibers f, especially when the elongated flexible member bends. The most preferred materials for the matrix are epoxy resin, polyester, phenolic plastic or vinyl ester. The polymer matrix m is preferably so hard that its module of elasticity (E) is over 2 GPa, most preferably over 2.5 GPa. In this case the module of elasticity E is preferably in the range 2.5-10 GPa, most preferably in the range 2.5-4.5 GPa. There are commercially available various material alternatives for the matrix m which can provide these material properties. Preferably over 50% proportion of the surface area of the cross-section of the tension member 14 is of the aforementioned reinforcing fiber, preferably such that 50%-80% proportion is of the aforementioned reinforcing fiber, more preferably such that 55%-70% proportion is of the aforementioned reinforcing fiber, and substantially all the remaining surface area is of polymer matrix m. Most preferably, this is carried out such that approx. 60% of the surface area is of reinforcing fiber and approx. 40% is of matrix material (preferably epoxy material). In this way a good longitudinal stiffness for the tension member 14 is achieved. As mentioned carbon fiber is the most preferred fiber to be used as said reinforcing fiber due to its excellent properties in hoisting appliances, particularly in elevators. However, this is not necessary as alternative fibers could be used, such as glass fiber, which has been found to be suitable as well. The member 2 is preferably completely non-metallic, i.e. made not to comprise any metal.

The flexible member 2 is furthermore such that the aforementioned tension member 14 or a plurality of tension members 6, comprised in the flexible member 2, together cover majority, preferably 70% or over, more preferably 75% or over, most preferably 80% or over, most preferably 85% or over, of the width of the cross-section of the flexible member 2 for essentially the whole length of the flexible member 2. Thus the rigidity of the flexible member 2 with respect to its total lateral dimensions is good, and the flexible member 2 does not need to be formed very large.

Figure 9:
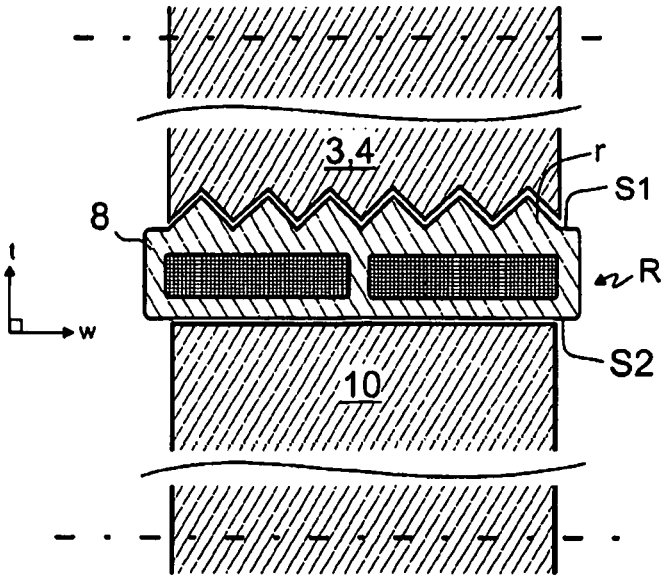
FIG. 9 illustrates a cross section of rollers and an elongated flexible member of FIG. 2*a* as viewed in vertical direction when implemented with an elongated flexible member in accordance with the embodiment of FIG. 5.

FIG. 9 illustrates an embodiment where the elongated flexible member 2 is ribbed, and comprises a lateral side S1 provided with a rib-pattern of elongated ribs r extending parallel with the longitudinal direction l of the member 2, said lateral side S1 being a wide lateral side of the elongated flexible member 2 against which the first roller 3 and the second roller 4 are tensioned. Each said roller 3,4 comprises a rib-pattern forming a counterpart for the pattern of the lateral side S1. Said ribs r are formed by the coating 8.

In the preferred embodiments, the advantageous structure for the the elongated flexible member 2 has been disclosed. However, the invention can be utilized with also other kind of the elongated flexible members such as belt-shaped the elongated flexible members having different materials, e.g. with a belt having tension members in the form of cords made of aramid or steel wires twisted together. Also, the outer shape of the elongated flexible member 2 could be contoured otherwise than disclosed. In the illustrated embodiments, the tension members 14 are substantially rectangular and larger in width direction than thickness direction. However, this is not necessary as alternative shapes could be used.

In the preferred embodiment, the first and second roller (3,4) are tensioned against the same lateral side (S1) of the elongated flexible member (2). This is however not necessary, as they could be alternatively be tensioned against opposite lateral sides of the elongated flexible member. Then, the arrangement could be for example as illustrated in Figure but the auxiliary roller 10 would be replaced by the second roller 4.

In the preferred embodiment, any required processing can be carried out by processing means such as microprocessor (s) comprised in the monitoring unit 13. Preferably the speeds mentioned are either rpm-values of the rollers or circumferential speed values of the rollers. Most preferably the speeds are however circumferential speeds of the rollers, because circumferential speed of the roller at the same time expresses the relative speed of the car and the elongated flexible member 2, which can be simply used for comparison with upper limit value(s) determined for the speed of the car 1. The limit value(s) can thus be set in accordance with upper limit speed of the car 1 without complex transformations.

Said drive means M,40,100 of the elevator preferably comprises one or more rope wheels 40,41 comprise a drive wheel 40 engaging said roping R and the elevator comprises a motor M for rotating the drive wheel 40. The elevator further comprises an elevator control unit 100 for automatically controlling rotation of the motor M, whereby the movement of the car 1 is also made automatically controllable. Said one or more rope wheels 40,41 are in the embodiment of FIG. 1 mounted in proximity of the upper end of the hoistway H. In this case the one or more rope wheels 40,41 are mounted inside the upper end of the hoistway, but alternatively they could be mounted inside a space beside or above the upper end of the hoistway H.

As mentioned, the elongated flexible member 2 is mounted such that it remains stationary when the car 1 is moved in the hoistway. Thus, it does not form part of the suspension roping of the elevator, suspending the movable elevator units such as car or counterweight. Thus, the elongated flexible member 2 is a component serving primarily, and preferably only, the function of speed monitoring. It is particularly preferable the elevator has only components of said car speed monitoring arrangement arranged to travel along the elongated flexible member 2 whereby the elevator does not have any other component arranged to travel along the surface of the elongated flexible member 2. This would be likely to cause smudge, wear or some other disturbance with the effect of deteriorating the traction between the elongated flexible member 2 and the rollers 3,4 thereby causing eventually slip or contact failures.

It is preferable, that the elastic bendability of made considerable. It is preferable even, that the elongated flexible member 2 is a rod having a straight form when in rest state and elastically bendable away from the straight form. Thus, it self-reverses back to a straight form from bent form in rest state after all bending directed to it ceases. Thus, the advantages of said elastic bendability are most considerable. As a result a 1.0 meter length of the member 2 straightens back when released after a bending from straight form to a curved form, in which bending the member 2 is bent along its complete length to a curved form with a constant radius within the range of 0.3-0.5 meter. Thereby the feature can be tested for example by bending in this way.

In addition for the use related to detecting overspeed and subsequent stopping, the speed detection data obtained by the rollers, as well as the car brake, can be used to serve other functions of the elevator, such as for detecting and stopping unintended car movement or for so called antirebound function.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims.

The invention claimed is:

1. An elevator, comprising:

a hoistway having a longitudinal direction;

an elevator car configured to travel in said hoistway along a path extending in said longitudinal direction; and a car speed monitoring assembly, the car speed monitoring assembly including an elongated flexible member tensioned to extend in said hoistway in said longitudinal direction, a first roller and a second roller, each roller of the first roller and the second roller mounted rotatably on the elevator car and tensioned against a common lateral side of the elongated flexible member and configured to roll along a surface of the common lateral side of the elongated flexible member based on the elevator car moving relative to the elongated flexible member, an auxiliary roller mounted rotatably on the car and tensioned against an opposite lateral side of the elongated flexible member in relation to the common lateral side, the auxiliary roller configured to roll along the surface of the opposite lateral side when the car moves relative to the elongated flexible member, the auxiliary roller between the first roller and the second roller as viewed along a length of the elongated flexible member, the auxiliary roller tensioned against the elongated flexible member such that the elongated flexible member is configured to bend to extend slightly into a gap existing in a vertical direction between the first roller and the second roller, and at least one spring configured to pull the first and second rollers and the auxiliary roller towards each other to tension the first and second rollers and the auxiliary roller against the elongated flexible member such that a gap between the first and second rollers and the auxiliary roller is narrowed, the car speed monitoring assembly configured to detect a first rotation speed of the first roller and a second rotation speed of the second roller, trigger one or more particular actions based on at least one rotation speed of the first rotation speed or the second rotation speed exceeding a limit speed, and trigger the one or more particular actions based on comparing the first rotation speed with the second rotation speed and determining that the first rotation speed and the second rotation speed deviate from each other;

wherein the one or more particular actions include at least causing movement of the elevator car to be stopped.

2. An elevator according to claim 1, wherein the elongated flexible member comprises a coating made of polymer material, the coating forming an outer surface of the elongated flexible member, the outer surface of the elongated flexible member including the surface of the common lateral side of the elongated flexible member, and each roller of the first roller and the second roller is tensioned against one lateral side of the elongated flexible member formed by the coating and is configured to roll along the outer surface.

3. An elevator according to claim 2, wherein the elongated flexible member includes one or more tension members embedded in the coating.

4. An elevator according to claim 3, wherein said one or more tension members include composite material, the composite material including reinforcing fibers embedded in polymer matrix, the reinforcing fibers including carbon fibers.

5. An elevator according to claim 1, wherein the elongated flexible member is toothed or ribbed, such that the elongated flexible member includes one or more lateral sides having a pattern of a tooth-pattern or a rib-pattern, at least one roller of the first roller and the second roller including a tooth-pattern or a rib-pattern forming a counterpart for the pattern of the one or more lateral sides.

6. An elevator according to claim 1, wherein the elongated flexible member is belt-shaped and has two lateral sides, and at least one roller of the first roller and second roller is tensioned against one lateral side of the two lateral sides.

7. An elevator according to claim 1, wherein the elongated flexible member is mounted such that the elongated flexible member is fixed in the hoistway.

8. An elevator according to claim 1, wherein the car speed monitoring assembly includes one or more rotation speed detectors configured to detect respective rotation speeds of the first roller and the second roller, each detector of the one or more rotation speed detectors being an electrical detector, the electrical detector including an encoder.

9. An elevator according to claim 8, wherein said one or more rotation speed detectors include a first detector configured to detect the first rotation speed of the first roller, and a second detector configured to detect the second rotation speed of the second roller, wherein each detector of the first detector and the second detector includes an encoder.

10. An elevator according to claim 1, wherein the first roller and the second roller are tensioned against a common lateral side of the elongated flexible member.

11. An elevator according to claim 1, further comprising:

one or more guide rail lines mounted in the hoistway, the one or more guide rail lines configured to guide movement of the elevator car, and one or more car brakes mounted on the elevator car, the one or more car brakes configured to actuate to engage a guide rail line of the one or more guide rail lines to induce braking movement of the elevator car, and the causing movement of the elevator car to be stopped includes inducing actuation of said one or more car brakes.

12. An elevator according to claim 1, further comprising:

one or more guide rail lines mounted in the hoistway, the one or more guide rail lines configured to guide movement of the elevator car, and one or more car brakes mounted on the elevator car, the one or more car brakes configured to be actuated with an electrical control signal to engage a guide rail line of the one or more guide rail lines to induce braking movement of the elevator car.

13. An elevator according to claim 12, wherein the car speed monitoring assembly is connected with the one or more car brakes via an electrical connection configured to send the electrical control signal to the one or more car brakes.

* * * * *